US007117642B2

(12) United States Patent
Brown

(10) Patent No.: US 7,117,642 B2
(45) Date of Patent: Oct. 10, 2006

(54) END CAP FOR RAIN GUTTERS

(75) Inventor: Lee J. Brown, Cincinnati, OH (US)

(73) Assignee: The Guttershsutter Manufacturing Company, Cincinnati, OH (US)

( * ) Notice: Subject to any disclaimer, the term of this patent is extended or adjusted under 35 U.S.C. 154(b) by 93 days.

(21) Appl. No.: 10/724,964

(22) Filed: Dec. 1, 2003

(65) Prior Publication Data

US 2005/0115159 A1 Jun. 2, 2005

(51) Int. Cl.
*E04D 13/00* (2006.01)

(52) U.S. Cl. ..... 52/11; 405/42; 248/48.1

(58) Field of Classification Search ..... 52/11, 52/12, 13, 16; 405/119, 40, 42; 248/48.1
See application file for complete search history.

(56) References Cited

U.S. PATENT DOCUMENTS

| | | | | |
|---|---|---|---|---|
| 1,062,778 | A * | 5/1913 | Hedrick | 405/106 |
| 1,460,733 | A | 7/1923 | Rigby | 405/119 |
| 2,461,610 | A * | 2/1949 | Lord | 52/12 |
| 4,142,370 | A * | 3/1979 | Giordano | 405/119 |
| 4,190,988 | A * | 3/1980 | Carreiro | 52/16 |
| 4,407,097 | A * | 10/1983 | Allen | 52/11 |
| 4,696,131 | A * | 9/1987 | Schreffler | 52/11 |
| 4,936,061 | A * | 6/1990 | Palma | 52/12 |
| 5,315,090 | A * | 5/1994 | Lowenthal | 219/213 |
| 5,501,547 | A * | 3/1996 | Mantelli | 405/121 |
| 5,529,436 | A * | 6/1996 | Meyers | 405/119 |
| 5,645,367 | A * | 7/1997 | Gunter | 404/3 |
| 5,865,498 | A * | 2/1999 | Grogan | 296/163 |
| 6,027,283 | A * | 2/2000 | Schweinberg et al. | 405/42 |
| 6,540,437 | B1 * | 4/2003 | Larson | 405/90 |

* cited by examiner

*Primary Examiner*—Naoko Slack
(74) *Attorney, Agent, or Firm*—Alfred J. Mangels

(57) ABSTRACT

An end cap for rain gutters having an overlying cover for deflecting leaves and other debris to prevent gutter and downspout clogging. The end cap includes a gutter trough closure region, for blocking water flow from the end of the gutter, and a second, above-trough closure region for blocking entry of leaves and other debris into the end of the gutter between the gutter trough and the overlying cover.

11 Claims, 3 Drawing Sheets

END CAP FOR RAIN GUTTERS

BACKGROUND OF THE INVENTION

1. Field of the Invention

The present invention relates to a rain gutter end cap. More particularly, the present invention relates to a rain gutter end cap that is physically connected with a gutter end and also with a bracket positioned within the gutter and adjacent to the gutter end.

2. Description of the Related Art

Rain gutters are generally open troughs that are arranged along the roof line of a building and in a position to catch surface water runoff from a pitched roof. A gutter is usually connected with a fascia board on the building and includes one or more downspouts to carry away the roof water runoff and direct it in a desired direction away from the building. Because open gutters are U-shaped, end caps are installed at the gutter open ends, so that the water collected by the gutter does not flow out the open ends of the gutter, and either along the outer wall of the building, which could cause building damage, or directly onto the ground below, which cold cause erosion damage or undesired splashing.

The commonly installed open gutters are susceptible to clogging by leaves and other debris that may be blown onto the roof. When the downspout becomes clogged one must remove the clogged material so the gutter does not overflow and defeat the purpose for installing it in the first place. Removal of such collected material is most often accomplished by manually removing it, which usually requires mounting a ladder to access the gutter downspout opening to enable the clogging materials to be removed. To solve the gutter cleaning problem and to prevent gutter clogging various gutter designs have been developed over the years in which a cover is supported above the gutter trough opening to act as a deflector of leaves and debris, so that they do not enter the gutter to accumulate and clog the downspout opening. However, gutter end caps provided on such covered gutters commonly extend completely across the gutter end opening, but not above the front edge of the gutter, which could allow leaves and debris to be blown by the wind into the gap between the top edge of the gutter end cap and the gutter cover panel. Additionally, gutter end caps are most commonly attached directly to the gutter ends, such as by crimping, which is not always a completely secure connection.

There is thus a need for a gutter end cap that closes off the entire end of a covered gutter and that is securely connected to the gutter in such a way as to allow it to be permanently retained on the gutter.

SUMMARY OF THE INVENTION

Briefly stated, in accordance with one aspect of the present invention, a rain gutter end cap is provided for covering the entire open end of a gutter having a leaf- and debris-deflecting cover panel. The end cap includes an end panel having an inner surface and an outer surface, and having a perimeter with a predetermined peripheral shape to completely close the gutter end. A first connection means is carried by the end panel for connecting the end cap with an end of the gutter. A second connection means is provided that is carried by the end panel for connecting the end cap with a support bracket carried within the gutter for supporting the gutter cover panel.

In accordance with a further aspect of the present invention the first connection means is a peripheral slot that receives the end of the gutter.

In accordance with a still further aspect of the present invention the second connection means includes at least one aperture in the end panel for receiving a connecting member for connection with the gutter support bracket.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

Figure 1:
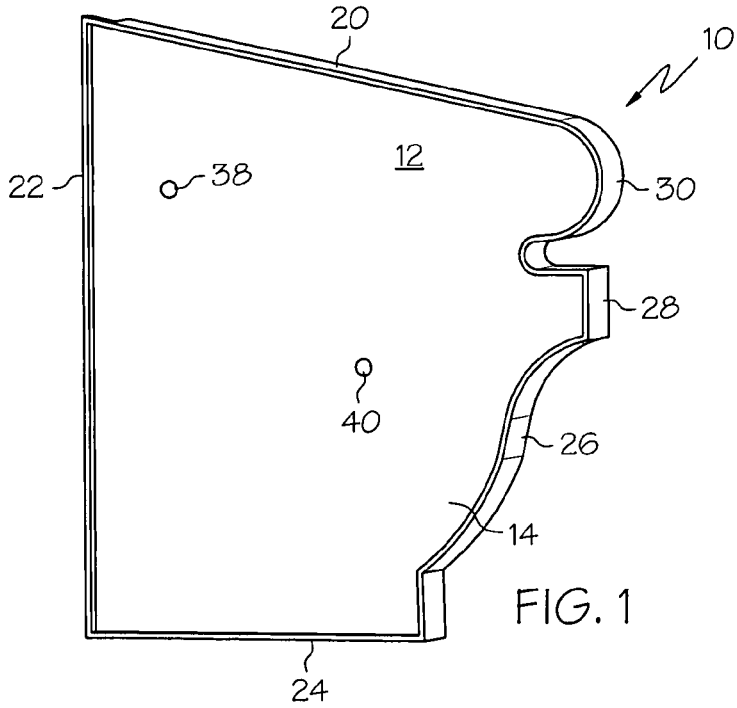
FIG. 1 is an end perspective view of the outer surface of an embodiment of a gutter end cap.
Figure 2:
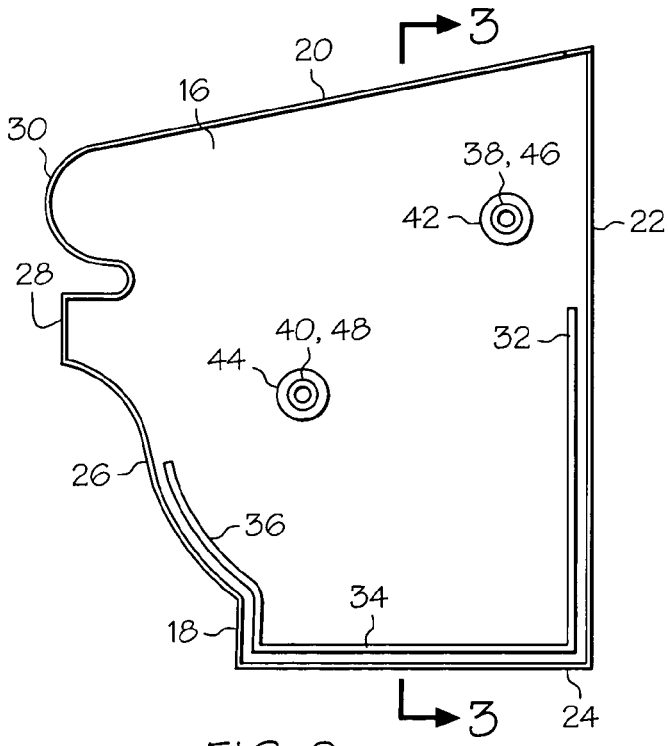
FIG. 2 is an end view of the inner surface of the gutter end cap shown in FIG. 1.
Figure 3:
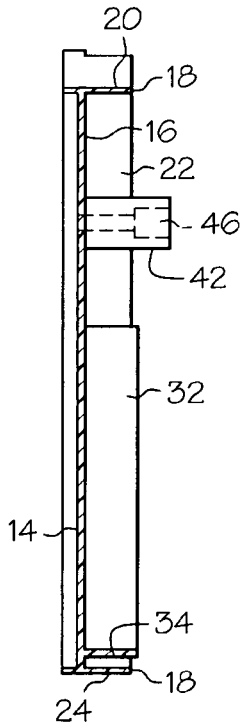
FIG. 3 is a cross-sectional view taken along the line 3—3 of FIG. 2.
Figure 4:
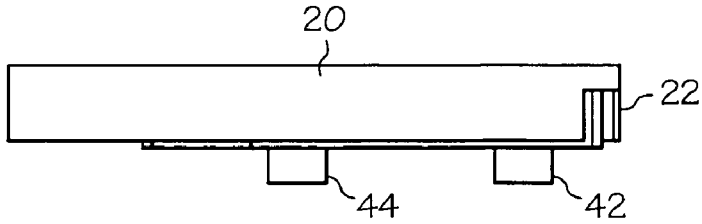
FIG. 4 is a top view of the gutter end cap shown in FIG. 1.
Figure 5:
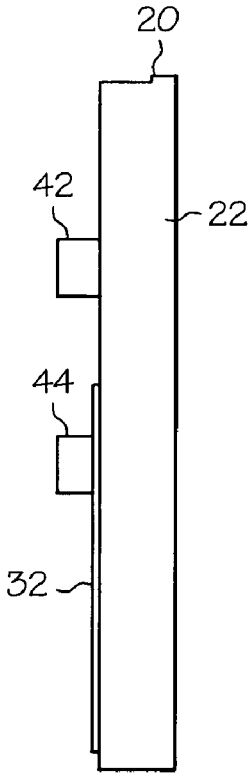
FIG. 5 is a left side view of the gutter end cap shown in FIG. 1.
Figure 6:
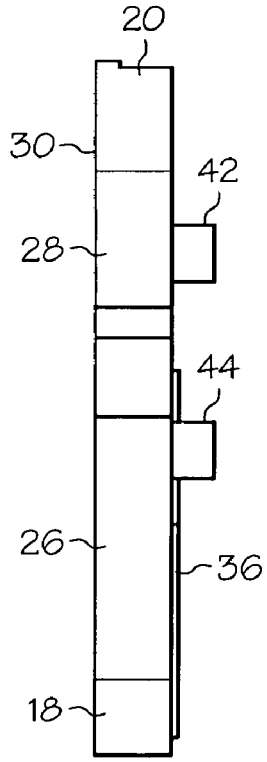
FIG. 6 is a right side view of the gutter end cap shown in FIG. 1.

Referring to the drawings, and particularly to FIGS. 1 through 3 thereof, there is shown an end cap 10 that is configured so that it can be applied at an end of a gutter that includes a trough and a gutter cover panel that overlies the trough and serves as a leaf and debris deflector. End cap 10 includes an end panel 12 that is substantially flat, although it could be slightly convex or concave, if desired. End panel 12 includes an outer face 14 and an inner face 16, and it has a perimeter that corresponds in shape with that of the cross section that is defined by the gutter and its cover panel, so that when the end cap is applied to an end of the gutter it completely closes the end of the gutter-cover assembly. Although only a left hand end cap is shown and described, it will be apparent to those skilled in the art that a right hand end cap will be the mirror image of the left hand end cap.

Positioned along the perimeter of end panel 12 is a peripheral flange 18 that extends from end panel 12 in a direction toward the gutter to which end cap 10 it is intended to be applied. Flange 18 is substantially perpendicular to inner face 16 and is a substantially continuous outer peripheral wall that defines an end cap top wall 20, an end cap rear wall 22, an end cap bottom wall 24, and an end cap front wall 26. Top wall 20 and rear wall 22 define an included angle of less than 90°, because the gutter cover panel slopes downwardly away from the building to which the gutter is attached, to allow the roof runoff to flow toward the front of the gutter. Bottom wall 24 is substantially perpendicular to rear wall 22, while front wall 26 has a shape that corresponds with that of the front wall of the gutter. As shown herein, front wall 26 is convexly curved and includes a first outward projection 28 that corresponds in shape with the cross-sectional shape of the front lip of the gutter, and a second outward projection 30 that corresponds in shape with the cross-sectional shape of a front lip of the gutter cover panel.

As best seen in FIGS. 2 and 3, spaced inwardly of a portion of end cap rear wall 22, and parallel thereto, is a first inner wall 32. Similarly, spaced inwardly of and parallel to end cap bottom wall 24 is a second inner wall 34, and spaced inwardly of a portion of front wall 26 and parallel thereto is a third inner wall 36. Inner walls 32, 34, and 36 together with outer walls 22,24, and 26 define a slot that has spacing corresponding substantially with the wall thickness of the corresponding gutter panels so that end cap 10 fits snugly on the end of the gutter when it is installed.

As seen in FIG. 1, outer face 14 of end panel 12 includes a pair of apertures 38, 40. In that regard, connecting screws are inserted into apertures 38, 40 to securely connect end cap 10 with an inner gutter bracket 62 (see FIG. 9) having correspondingly positioned openings 64, 66, so that the end cap can be screwed to the bracket and thereby remain securely in place. Additionally, extending inwardly from inner face 16 of end cap 10, and aligned with respective apertures 38, 40 is a pair of bosses 42, 44, which include respective passageways 46, 48 that are aligned with respective ones of apertures 38, 40. Bosses 42 44 can have a length such that the free ends of the bosses are adapted to contact the gutter bracket. Passageways 46, 48 serve to guide the connecting screws to contact the bracket at correspondingly positioned screw-receiving apertures in the bracket.

FIGS. 4 through 7 show the outer surfaces of the different walls that define perimeter flange 18 of the end cap.

Figure 8:
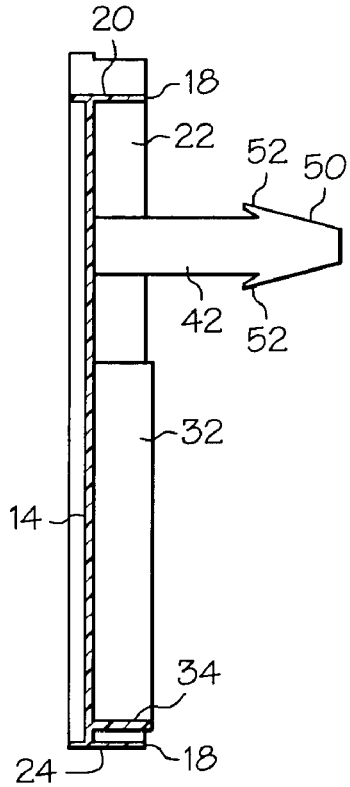
FIG. 8 is a cross-sectional view similar to that of FIG. 3 and showing one form of connection member positioned on the end cap inner surface for engagement with a gutter bracket.
Figure 7:
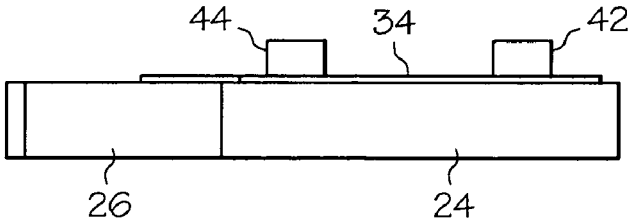
FIG. 7 is a bottom view of the gutter end cap shown in FIG. 1.

As an alternative method of connecting the end cap 10 with the gutter bracket 62, the bosses 42, 44 can carry engagement elements that are received in the adjacent gutter bracket 62 for interconnecting the end cap with the bracket. FIG. 8 shows one such alternative possible form of engagement element, in the form of a flexible, wedge-shaped end 50 formed on the outer end of the extended bosses 42, 44. End 50 includes one or more inclined arms 52 and is sized so that it fits into corresponding apertures in the gutter bracket 62 and passes therethrough so that arms 52 extend from the opposite side of the bracket and engage the bracket side to prevent removal of the associated boss from the bracket. A further alternative can be an interference fit between extended bosses 42, 44 and a corresponding aperture formed in the gutter bracket 62.

Figure 9:
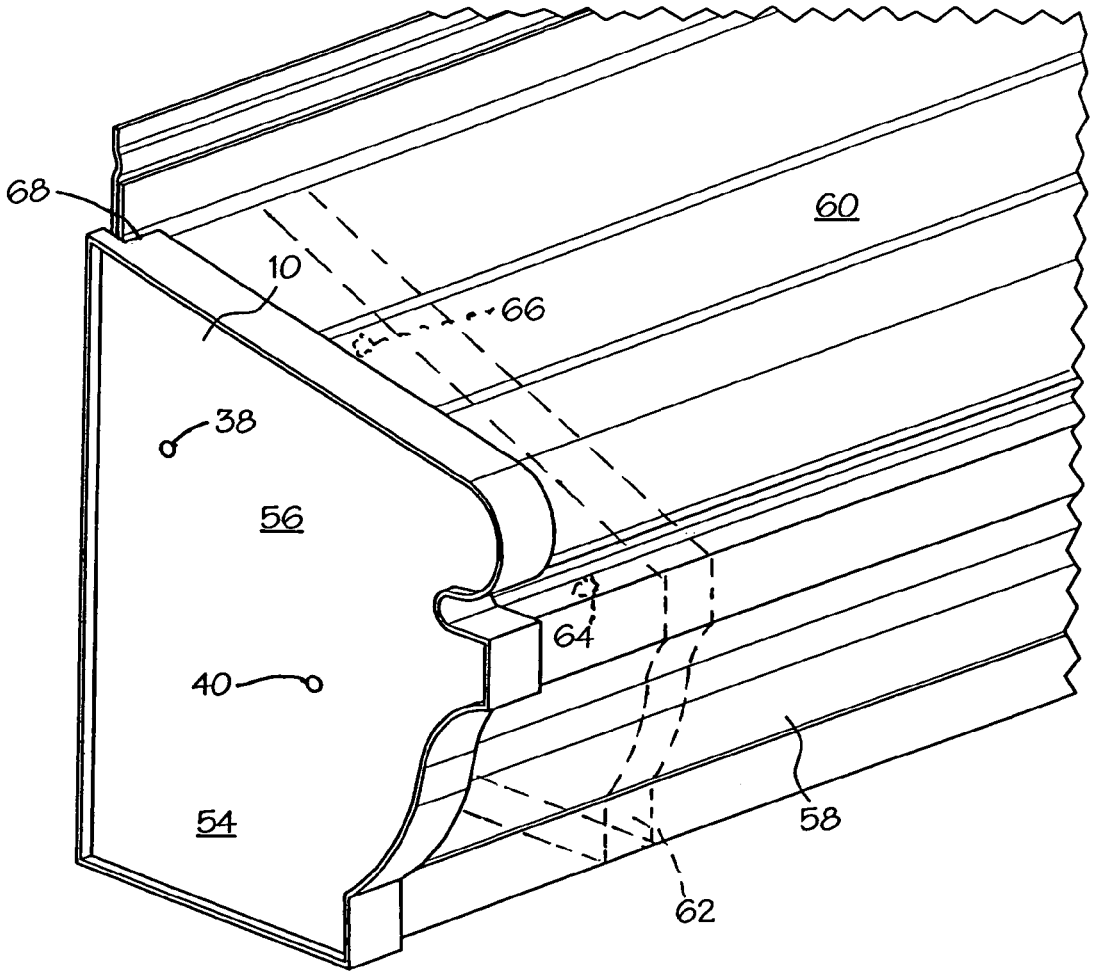
FIG. 9 is a fragmentary perspective view of a gutter including the end cap of FIG. 1 attached to an end of the gutter that has a top, debris-blocking cover.

As will be apparent from the foregoing, and as best seen in FIG. 9, the present invention provides an end cap 10 that includes a first closure region 54 and a second closure region 56. First closure region 54 is adjacent to gutter trough 58, and second closure region 56 is above first closure region 54 and is adjacent to a gutter cover panel 60. First region 54 serves to block the flow of water within gutter trough 58 so that the water does not flow out from the gutter ends, to thereby confine the water to instead exit from the gutter through one or more downspouts (not shown). Second region 56 serves to block the area between gutter trough 58 and a gutter cover panel 60, an area that would otherwise be open, to prevent the entry of leaves or other debris into the gutter from an otherwise open gutter end. The outer peripheral wall of end cap 10 includes a gap 68 between the end cap top wall 20 and the end cap rear wall 22 to receive a gutter rear wall panel portion.

Although particular embodiments of the present invention have been illustrated and described, it will be apparent to those skilled in the art that changes and modifications can be made without departing from the spirit of the present invention. Accordingly, it is intended to encompass within the appended claims all such changes and modifications that fall with the scope of the present invention.

What is claimed is:

1. A rain gutter end cap comprising:

a) an end panel having an inner surface and an outer surface and including a perimeter having a predetermined shape;

b) first connection means carried by the end panel for connecting the end cap with an end of a gutter, wherein the first connection means includes an outer peripheral wall extending laterally outwardly from the inner face of the end panel and an inner peripheral wall extending laterally outwardly from the inner face of the end panel and positioned inwardly of the outer peripheral wall to define therebetween a slot for receiving an end of a gutter; and c) second connection means carried by the end panel and including at least one aperture extending through the end panel for receiving a connecting member for connecting the end cap with a support bracket carried within the gutter.

2. An end cap in accordance with claim 1, wherein the outer peripheral wall defines an end cap top wall, an end cap rear wall, an end cap bottom wall, and an end cap front wall.

3. An end cap in accordance with claim 2, wherein the outer peripheral wall is substantially continuous.

4. An end cap in accordance with claim 3, wherein the outer peripheral wall and the inner peripheral wall are substantially perpendicular to the end panel inner surface.

5. An end cap in accordance with claim 4, wherein the inner peripheral wall extends laterally outwardly from the end panel inner surface a greater distance than the outer peripheral wall.

6. An end cap in accordance with claim 3, wherein the outer peripheral wall includes a gap between the end cap top wall and the end cap rear wall to receive a gutter rear wall panel portion.

7. An end cap in accordance with claim 2, wherein the inner peripheral wall extends substantially along and parallel to the end cap front wall, the end cap bottom wall, and the end cap rear wall.

8. An end cap in accordance with claim 7, wherein the inner peripheral wall extends along the end cap rear wall from a point between the end cap top wall and the end cap bottom wall, along the end cap bottom wall, and along the end cap front wall to a point between the end cap top wall and the end cap bottom wall.

9. A rain gutter end cap comprising:

a) an end panel having an inner surface and an outer surface and including a perimeter having a predetermined shape to correspond with the shape of an end of a gutter trough that includes an overlying gutter cover;

b) first connection means carried by the end panel for connecting the end cap with the end of the gutter trough; and c) second connection means carried by the end panel for connecting the end cap with a support bracket carried within the gutter trough, wherein the second connection means includes a projection extending outwardly from the end panel inner surface for contacting the support bracket.

10. An end cap in accordance with claim 9, wherein the projection includes a passageway for receiving a connecting member that interconnects the end cap with the support bracket.

11. An end cap in accordance with claim 9, wherein the projection terminates in a connector engageable with the support bracket.

* * * * *